US011933562B2

(12) United States Patent
Miller

(10) Patent No.: US 11,933,562 B2
(45) Date of Patent: Mar. 19, 2024

(54) TRIGGER SAFETY FOR A FIREARM

(71) Applicant: Alt Performance, LLC., Brambleton, VA (US)

(72) Inventor: Robert A. Miller, Brambleton, VA (US)

(73) Assignee: Alt Performance, LLC., Brambleton, VA (US)

( * ) Notice: Subject to any disclaimer, the term of this patent is extended or adjusted under 35 U.S.C. 154(b) by 115 days.

(21) Appl. No.: 17/533,180

(22) Filed: Nov. 23, 2021

(65) Prior Publication Data

US 2022/0163278 A1 May 26, 2022

Related U.S. Application Data

(60) Provisional application No. 63/116,948, filed on Nov. 23, 2020.

(51) Int. Cl.
*F41A 17/46* (2006.01)
*F41A 19/10* (2006.01)

(52) U.S. Cl.
CPC ..... *F41A 17/46* (2013.01); *F41A 19/10* (2013.01)

(58) Field of Classification Search
CPC ..... F41A 17/46; F41A 19/10; F41A 17/72
See application file for complete search history.

(56) References Cited

U.S. PATENT DOCUMENTS

| | | | | |
|---|---|---|---|---|
| 7,690,144 | B2 * | 4/2010 | Fagundes de Campos | F41A 17/72 42/70.08 |
| 10,222,159 | B1 | 3/2019 | Carr | |
| 10,801,794 | B2 | 10/2020 | Geissele | |
| 11,079,193 | B1 * | 8/2021 | Niswander | F41A 17/46 |
| 2005/0011098 | A1 * | 1/2005 | Fagundes de Campos | F41A 17/72 42/70.04 |
| 2015/0292828 | A1 * | 10/2015 | Nebeker | F41A 17/46 42/69.01 |
| 2019/0310043 | A1 * | 10/2019 | Taylor | F41A 19/31 |
| 2019/0331445 | A1 * | 10/2019 | Full | F41A 19/11 |
| 2020/0386502 | A1 * | 12/2020 | Niswander | F41A 19/10 |
| 2022/0316829 | A1 * | 10/2022 | Vaughan | F41A 3/68 |

* cited by examiner

*Primary Examiner* — Jonathan C Weber
(74) *Attorney, Agent, or Firm* — Wood Herron & Evans LLP

(57) ABSTRACT

A trigger mechanism for a firearm comprises a connector adapted to be pivotally connected to a firearm receiver, a trigger pivotally connected to the connector, and a trigger bar pivotally connected to the connector. The trigger and trigger bar are configured such that the trigger engages the trigger bar to block the connector from pivoting until the trigger is depressed rearwardly. The connector is permitted to pivot once the trigger is fully depressed rearwardly such that the trigger is not engaged with the trigger bar, whereupon pivotal motion of the connector drives the trigger bar rearwardly to release a striker of the firearm to fire the firearm.

6 Claims, 9 Drawing Sheets

TRIGGER SAFETY FOR A FIREARM

CROSS REFERENCES TO RELATED APPLICATIONS

This application claims the benefit of U.S. Provisional Patent Application No. 63/116,948, filed Nov. 23, 2020, the full disclosure of which is incorporated herein by reference.

FIELD OF THE INVENTION

The present invention relates to the field of safety mechanisms for firearms. Specifically, the present invention relates to a trigger assembly and related method for a firearm (e.g., a pistol, or another type of firearm). The trigger assembly minimizes inadvertent discharge of the firearm by blocking the trigger from rearward pivoting until pressure is applied to the trigger. The system and method employ a configuration wherein a camming surface is engaged with a protrusion of the trigger bar once the trigger assembly is connected to the receiver via a pivot that extends through the trigger assembly and at least a portion of the receiver.

BACKGROUND

It is desirable to prevent the accidental discharge of a firearm. Some known systems and methods include trigger guards and holstering systems that minimize the possibility that the trigger is activated (pivoted rearward) unintentionally. Some systems employ a mechanism that blocks the trigger from free rearward movement until a user's hand is holding the firearm. Other systems employ a mechanism that blocks the trigger from free rearward movement until a user's finger is on the trigger and applies pressure thereto. The present invention relates to the latter type of system.

SUMMARY

The present disclosure provides a trigger assembly and related method for a firearm (e.g., a pistol, or another type of firearm). The trigger assembly minimizes inadvertent discharge of the firearm by blocking the trigger from rearward pivoting until pressure is applied to the center portion of the trigger. The system and method employ a configuration wherein a camming surface is engaged with a protrusion of the trigger bar once the trigger assembly is connected to the receiver via a pivot that extends through the trigger assembly and at least a portion of the receiver.

In one general aspect, the subject matter described in this specification can be embodied in a trigger assembly including a trigger body, a connector, a trigger bar, a trigger pin, a trigger bar pin, and a trigger spring. The connector including an upper portion and a lower portion: the upper portion including a pivot; the lower portion including a forward pivot and a rearward pivot. The trigger bar including a forward portion, a middle portion, and a rearward portion: the forward portion including a pivot that extends through the forward pivot of the connector; the middle portion including a protrusion. The trigger body including a pivot, an upper portion, and a lower portion: the pivot extends through the rearward pivot of the connector; the lower portion including a downwardly extending finger engaging paddle release located below the pivot; the upper portion including a camming surface located above and rearward of the pivot; wherein the paddle release includes a depressed orientation; and wherein the camming surface is configured to engage the trigger bar protrusion when the paddle release is not in the depressed orientation. The trigger spring is configured to engage the trigger body camming surface with the trigger bar protrusion when the paddle release is not in the depressed orientation. In another aspect, the trigger spring biases the finger engaging paddle release forward when the paddle release is not in the depressed orientation.

In a second general aspect, the subject matter described in this specification can be embodied in a firearm that includes a receiver and a trigger assembly. The trigger assembly is installed within the receiver via a pin that extends through the upper portion pivot of the trigger assembly connector and at least a portion of the receiver. In some implementations, the pin may extend through a portion of another component which is connected to the receiver. The receiver may include any component that mounts to the receiver. For example, the trigger may be pinned to the unlock block, but a separate pin joins it to the receiver. The rearward portion of the trigger bar is configured to engage the fire control, typically via a trigger bar. In some implementations, a forward force is applied through the fire control into the trigger bar, biasing the trigger assembly forward in the receiver. In some implementations, a forward force is applied via a spring configured to bias the trigger assembly forward in the receiver. Forward bias of the trigger assembly automatically engages the trigger body camming surface with the trigger bar protrusion.

In another aspect, a trigger mechanism for a firearm comprises a connector adapted to be pivotally connected to a firearm receiver, a trigger pivotally connected to the connector, and a trigger bar pivotally connected to the connector. The trigger and trigger bar are configured such that the trigger engages the trigger bar to block the connector from pivoting until the trigger is depressed rearwardly. The connector is permitted to pivot once the trigger is fully depressed rearwardly such that the trigger is not engaged with the trigger bar, whereupon pivotal motion of the connector drives the trigger bar rearwardly to release a striker of the firearm to fire the firearm.

The trigger mechanism can further comprise a spring configured to engage an upper portion of the connector and an upper portion of the trigger to bias a lower portion of the trigger forwardly. The trigger can have a camming surface on a rearward side of an upper portion of the trigger and an intermediate portion of the trigger bar can have a protrusion. The camming surface and protrusion can be configured such that the camming surface and protrusion engage to block the connector from pivoting until a lower portion of the trigger is depressed rearwardly, and disengage to permit pivoting of the connector once the lower portion of the trigger is fully depressed rearwardly. The connector can have an upper rearward portion and the trigger can have an upper forward portion, and when the trigger is fully depressed rearwardly the upper forward portion of the trigger can be flush with the upper rearward portion of the connector. The trigger can pivot about 3 degrees to about 20 degrees for the upper forward portion of the trigger to be flush with the upper rearward portion of the connector. The pivot connection of the trigger to the connector can be rearward of the pivot connection of the trigger bar to the connector, and the pivot connection of the connector to the firearm receiver can be above the pivot connections of the trigger to the connector and the trigger bar to the connector.

In another aspect, a trigger mechanism for a firearm comprises a connector having an upper portion, a lower forward portion, and a lower rearward portion, the upper portion adapted to be pivotally connected to a firearm receiver, a trigger having an upper portion and a lower portion and being pivotally connected between the upper and lower portions to the lower rearward portion of said connector, a trigger bar having a forward portion, a rearward portion, and an intermediate portion between the forward and rearward portions, the forward portion pivotally connected to the lower forward portion of said connector, and a spring configured to engage the upper portion of the connector and the upper portion of the trigger to bias the lower portion of the trigger forwardly. The trigger has a camming surface on a rearward side of the upper portion of the trigger, and the intermediate portion of the trigger bar has a protrusion. The camming surface is configured to engage the protrusion to block the connector from pivoting until the lower portion of the trigger is depressed rearwardly. The connector is permitted to pivot once the lower portion of the trigger is fully depressed rearwardly such that the camming surface is not engaged with the protrusion, whereupon pivotal motion of the connector drives the forward portion of the trigger bar rearwardly creating translational movement of the rearward portion of the trigger bar to release a striker of the firearm to fire the firearm.

In another aspect, a method of assembling a trigger mechanism to a receiver of a firearm comprises providing the trigger mechanism comprising a connector, a trigger, a trigger bar, and a torsion spring, extending a first pin through a first aperture in the connector, through an aperture in the trigger bar, and through a second aperture in the connector, extending a second pin through a first aperture in the trigger, through a third aperture in the connector, through an aperture of the torsion spring, through a fourth aperture in the connector, and through a second aperture in the trigger, inserting the trigger mechanism into the receiver such that the trigger extends through a trigger slot in the receiver, and extending a third pin through a first aperture in the receiver, through a fifth aperture in the connector, and through a second aperture in the receiver.

The method can further comprise providing a camming surface on the trigger, and providing a protrusion on the trigger bar, the camming surface and protrusion configured such that the camming surface and protrusion engage to block the connector from pivoting until a lower portion of the trigger is depressed rearwardly, and disengage to permit pivoting of the connector once the lower portion of the trigger is fully depressed rearwardly. The method can further comprise providing cooperating surfaces on an upper rearward portion of the connector and on an upper forward portion and the trigger, the cooperating surfaces being flush when the trigger is fully depressed rearwardly. The method can further comprise pivoting the trigger about 3 degrees to about 20 degrees for the cooperating surfaces to be to be flush.

Particular implementations of the subject matter described in this specification can be implemented to realize one or more of the following advantages. Implementations may provide trigger safety in which the operation of the safety is imperceptible to the user. Implementations may provide a trigger safety with the feel of a multi-stage trigger. Implementations may include more or fewer parts than existing trigger safety devices.

Other aspects, features, benefits, and advantages of the present invention will be become apparent to a person of skill in the art from the detailed description of various embodiments with reference to the accompanying drawing figures, all of which comprise part of the disclosure.

BRIEF DESCRIPTION OF THE DRAWINGS

The present invention is illustrated by way of example and not limitation in the figures of the accompanying drawings in which like references indicate similar elements, wherein.

DETAILED DESCRIPTION

Figure 1:
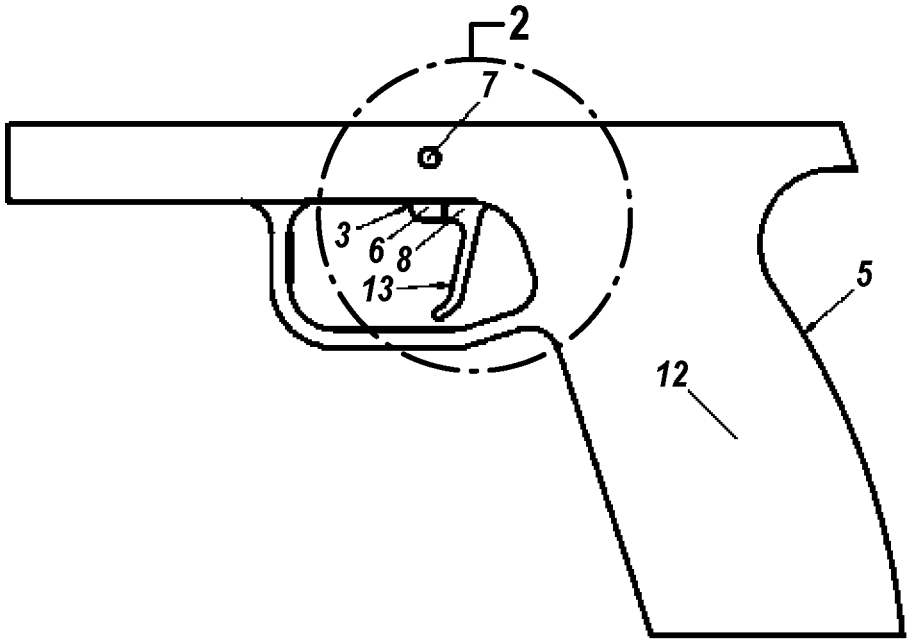
FIG. 1 illustrates an elevated view of the trigger assembly, according to one embodiment of the present invention.
Figure 2:
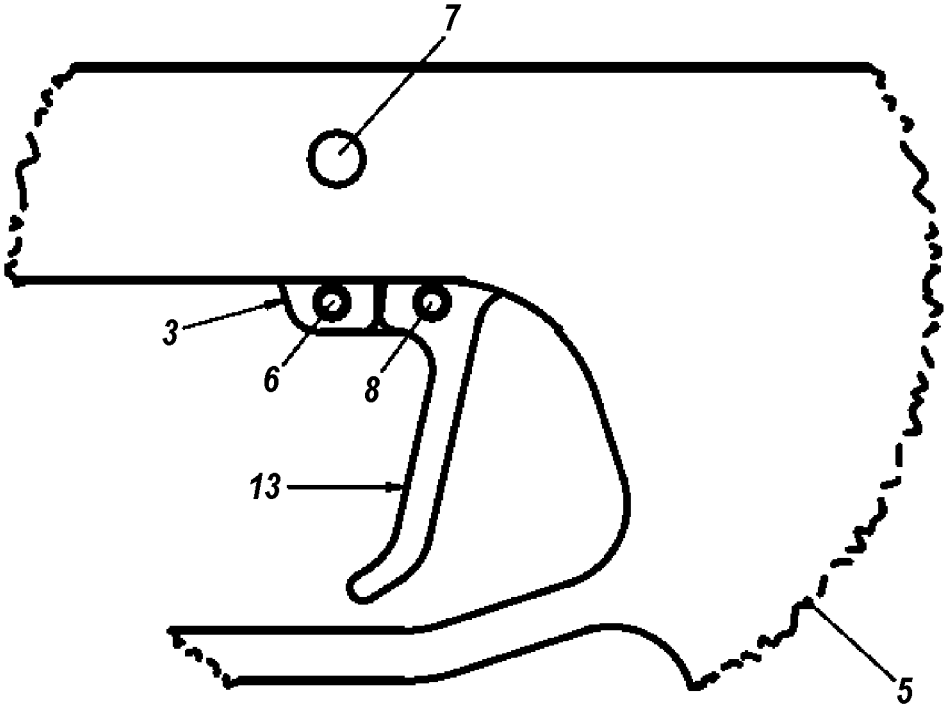
FIG. 2 illustrates an enlarged view of a portion of FIG. 1, according to one embodiment of the present invention.
Figure 3:
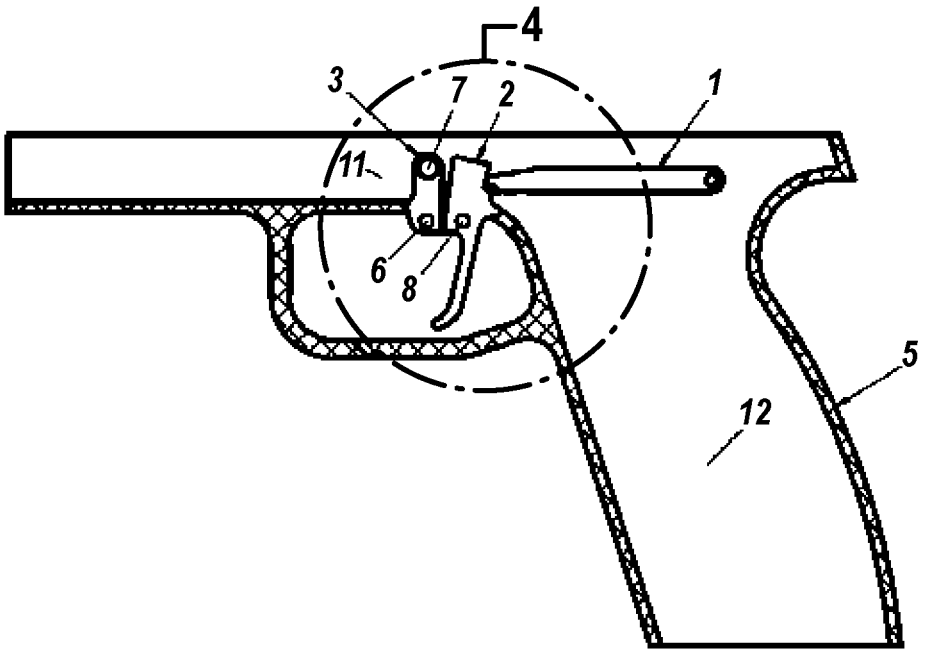
FIG. 3 illustrates a partial cross-sectional view of FIG. 1, according to one embodiment of the present invention.
Figure 4:
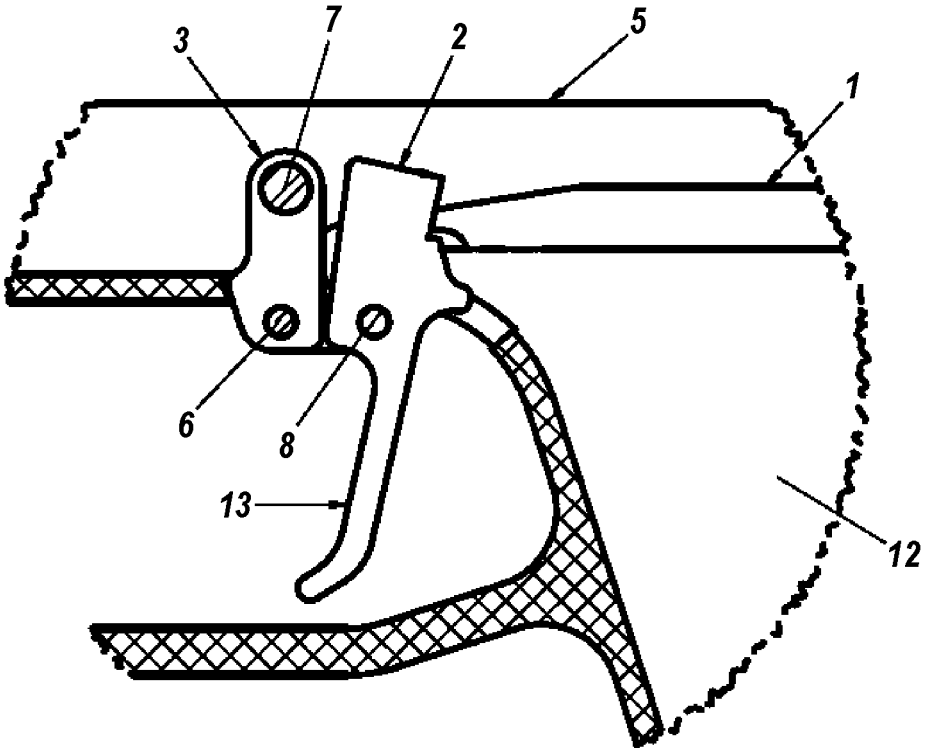
FIG. 4 illustrates an enlarged view of a portion of FIG. 3, according to one embodiment of the present invention.
Figure 5:
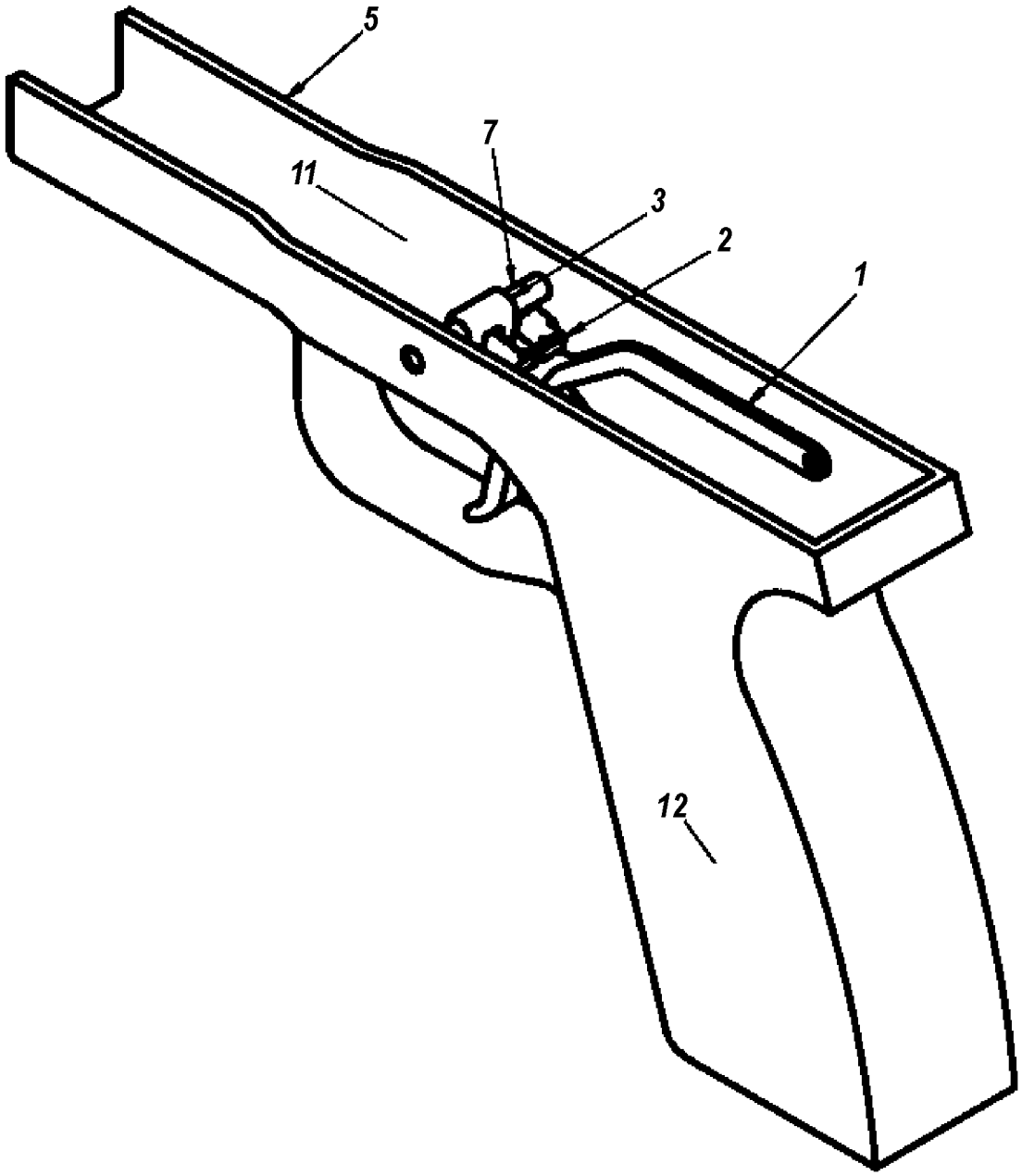
FIG. 5 illustrates a top perspective view of the trigger assembly of FIG. 1, according to one embodiment of the present invention.
Figure 6:
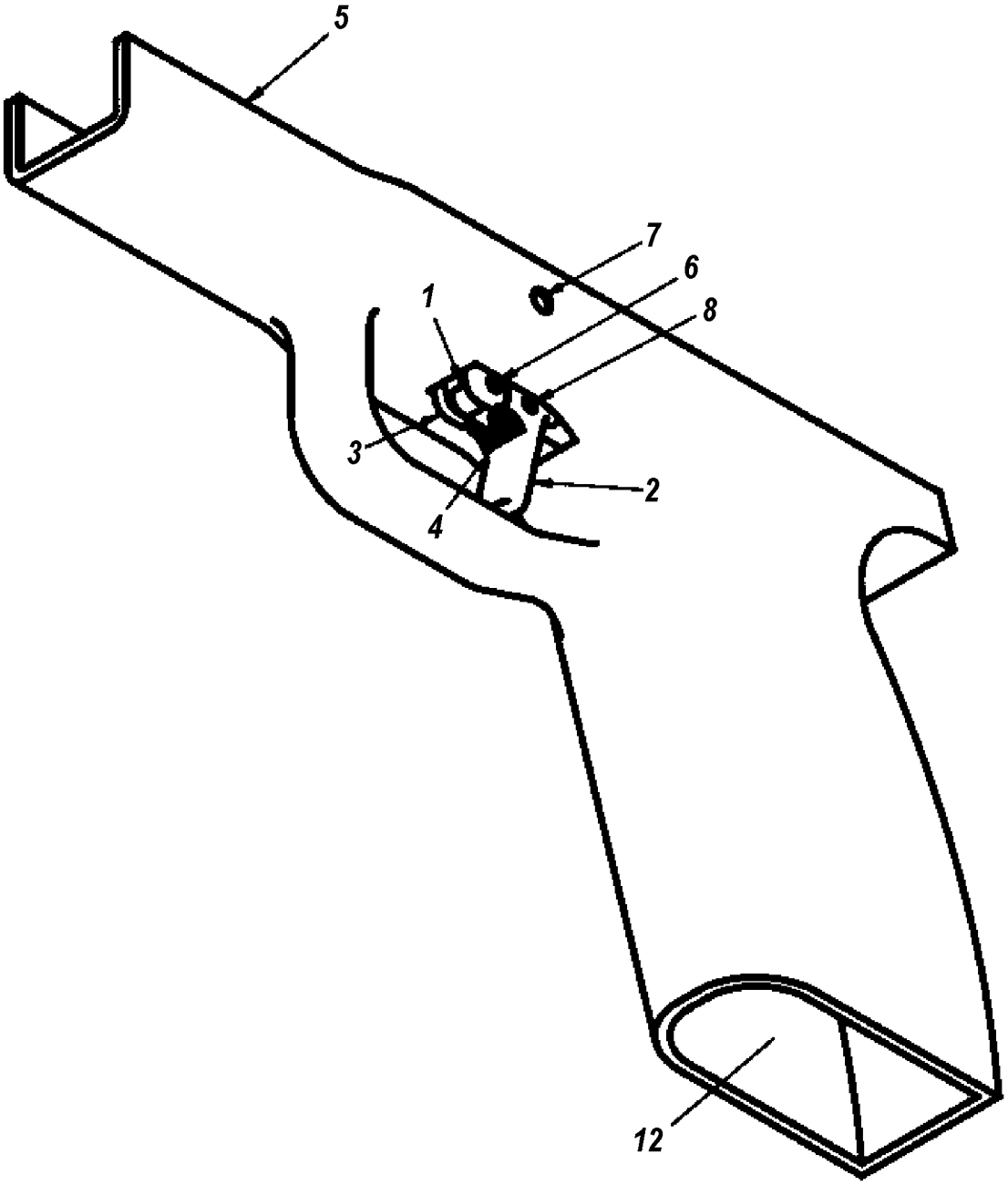
FIG. 6 illustrates a bottom perspective view of the trigger assembly of FIG. 1, according to one embodiment of the present invention.
Figure 7:
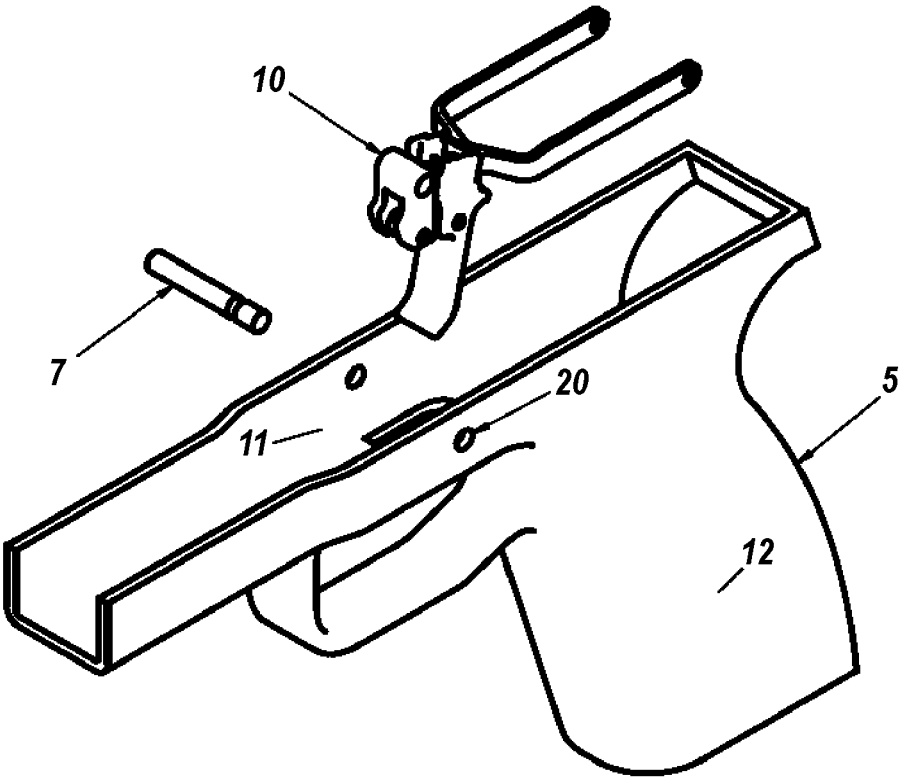
FIG. 7 illustrates an exploded assembly view of the trigger assembly of FIG. 1, according to one embodiment of the present invention.
Figure 8:
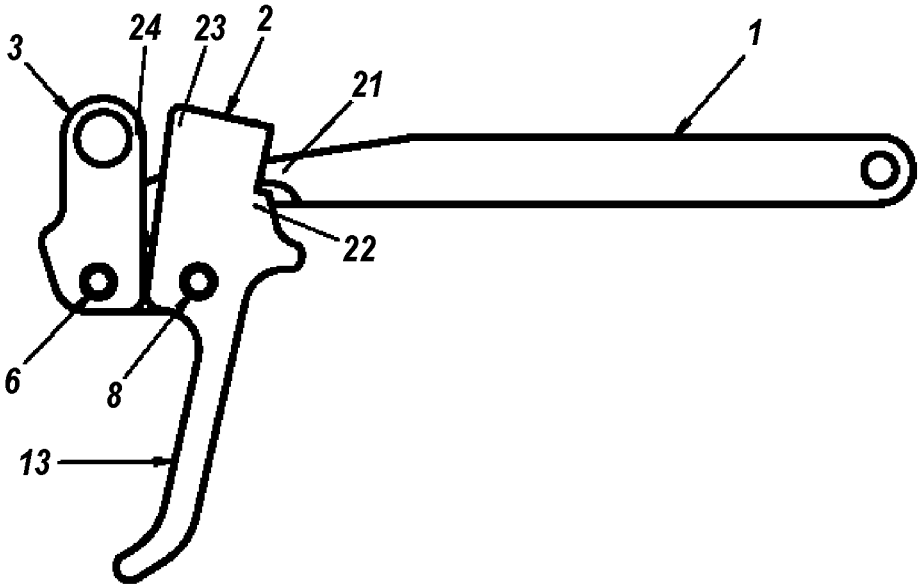
FIG. 8 illustrates an elevation view of the trigger assembly of FIG. 1, according to one embodiment of the present invention.
Figure 9:
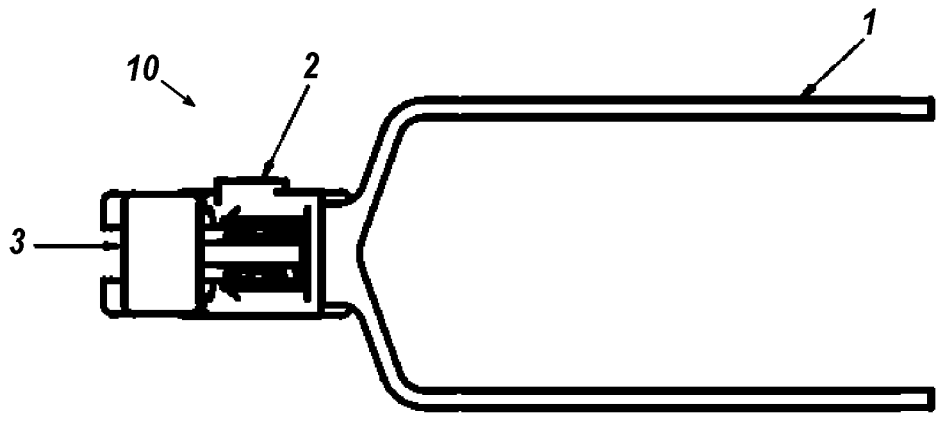
FIG. 9 illustrates a top view of the trigger assembly of FIG. 8, according to one embodiment of the present invention.
Figure 10:
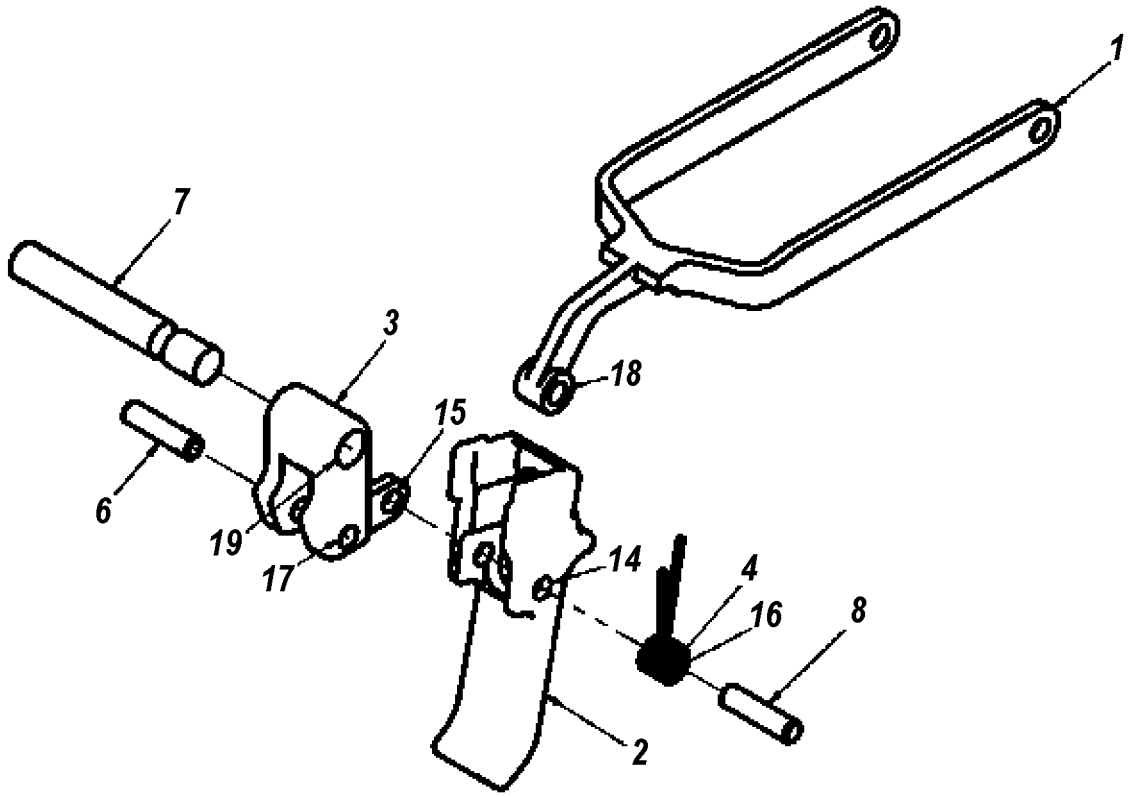
FIG. 10 illustrates an exploded assembly view of the trigger assembly of FIG. 8, according to one embodiment of the present invention.
Figure 11:
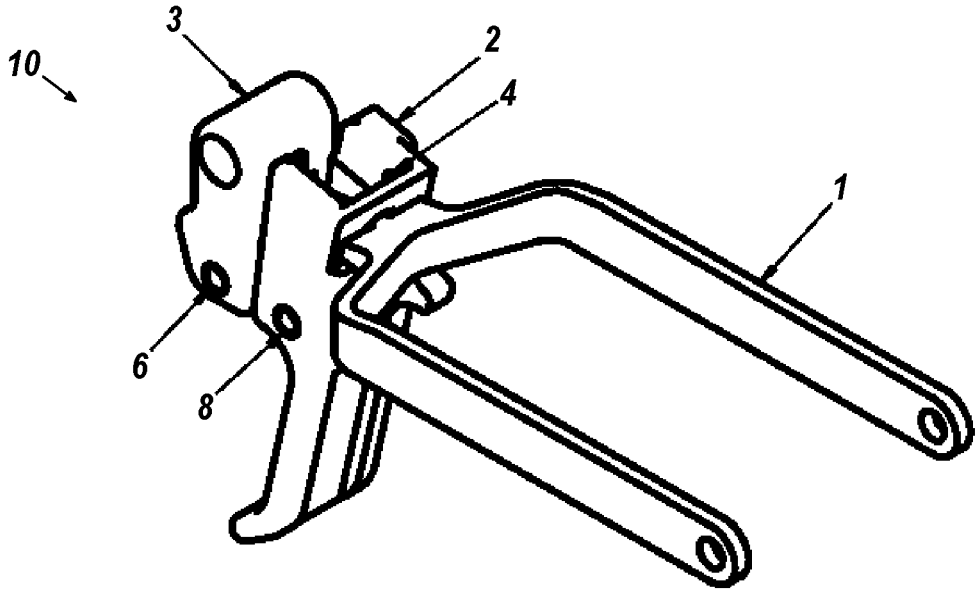
FIG. 11 illustrates a top perspective view of the trigger assembly of FIG. 8, according to one embodiment of the present invention.
Figure 12:
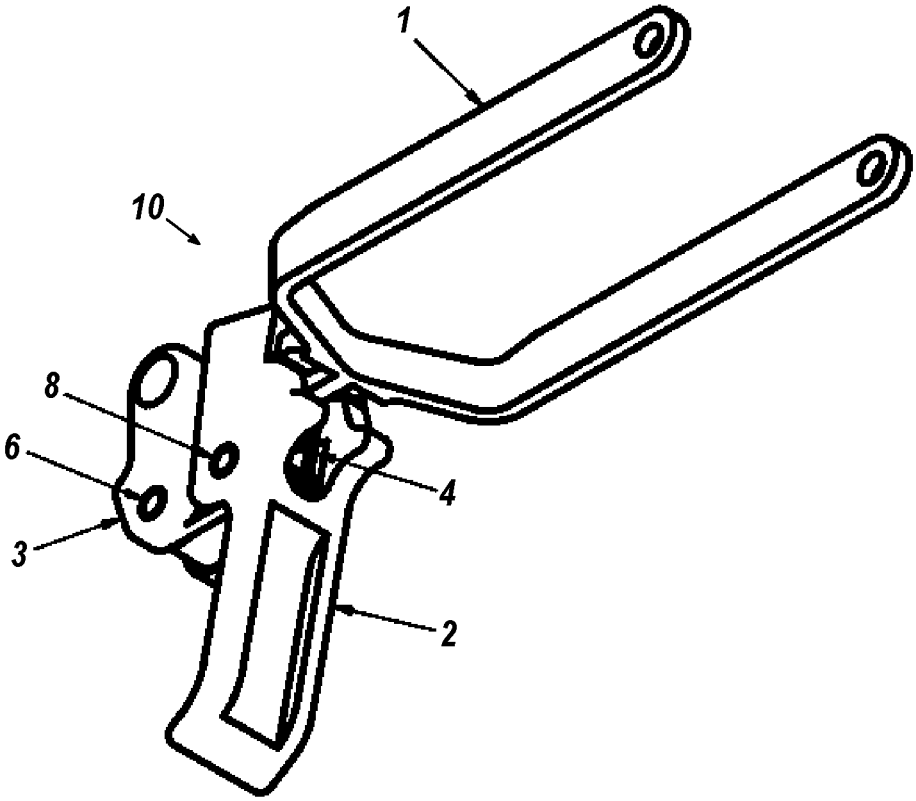
FIG. 12 illustrates a bottom perspective view of the trigger assembly of FIG. 8, according to one embodiment of the present invention.
Figure 13:
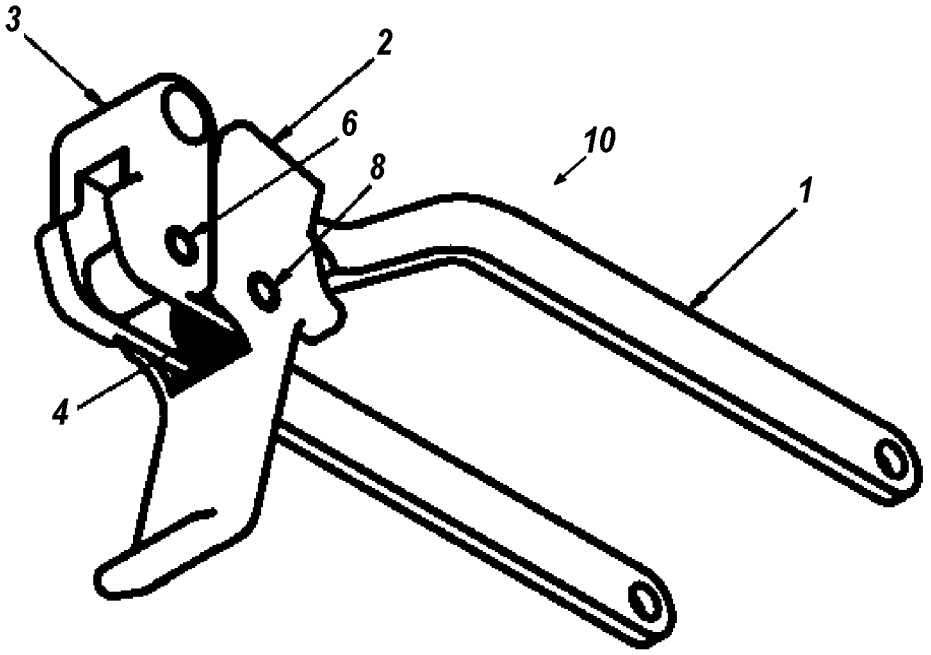
FIG. 13 illustrates a bottom perspective view of the trigger assembly of FIG. 8, according to one embodiment of the present invention.
Figure 14:
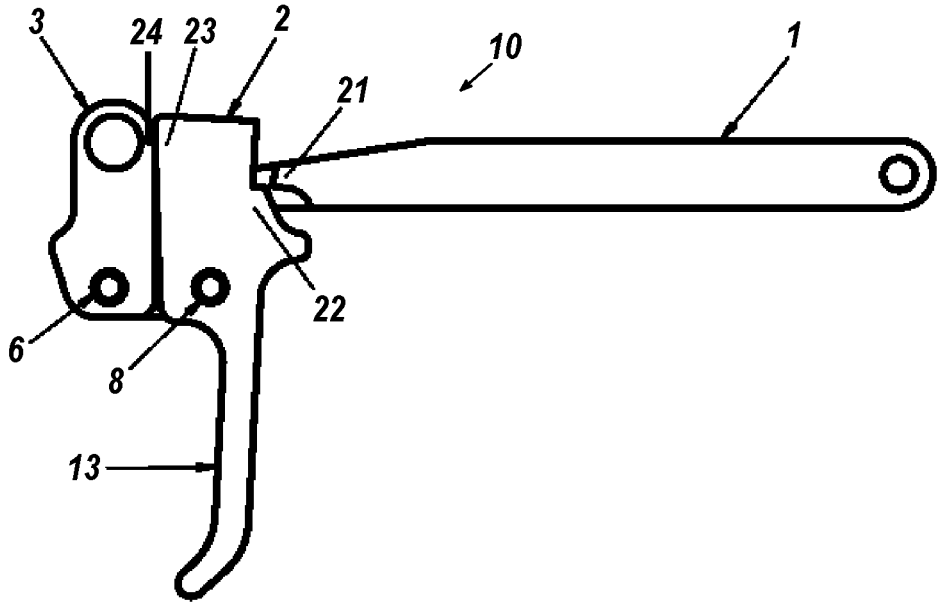
FIG. 14 illustrates an elevation view of the trigger assembly of FIG. 8 in a second orientation, according to one embodiment of the present invention.
Figure 15:
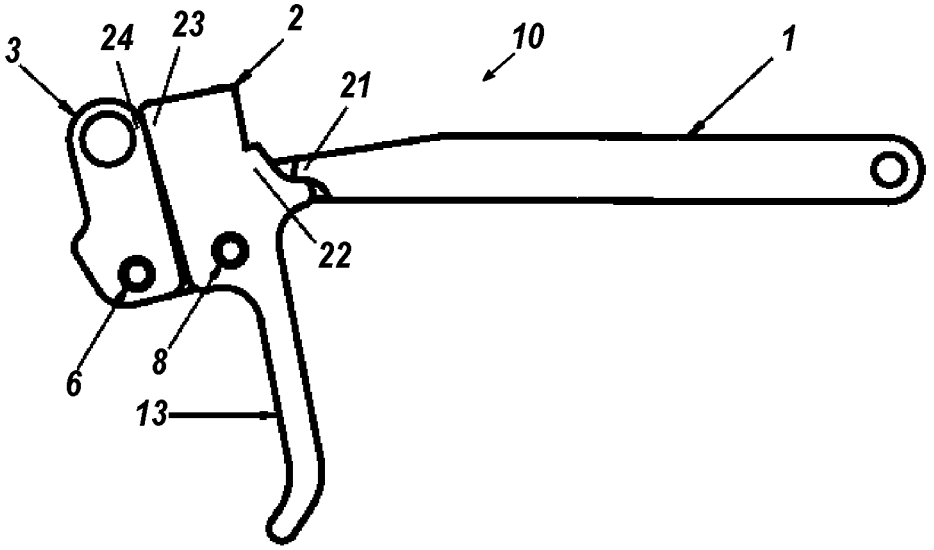
FIG. 15 illustrates an elevation view of the trigger assembly of FIG. 8 in a third orientation, according to one embodiment of the present invention.
Figure 16:
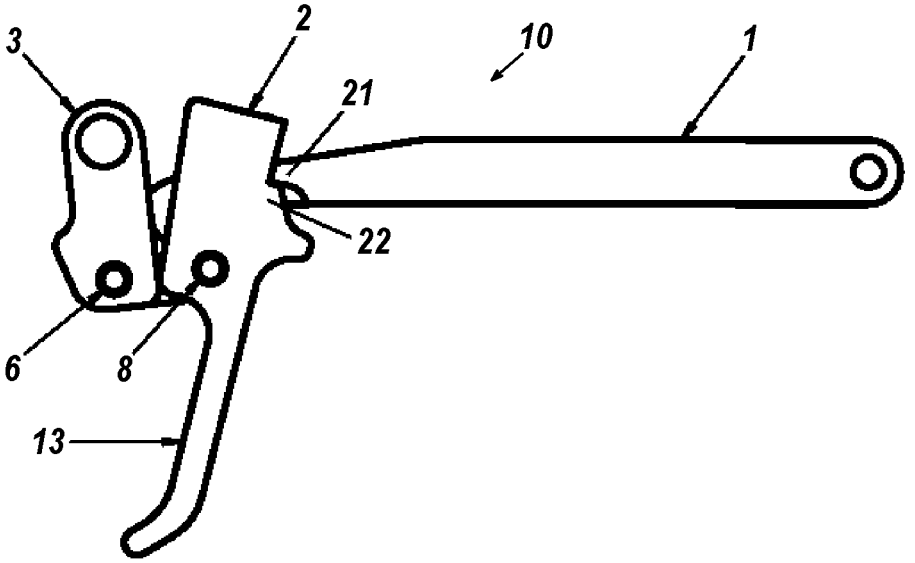
FIG. 16 illustrates an elevation view of the trigger assembly of FIG. 8 in a fourth orientation, according to one embodiment of the present invention.

Various embodiments and aspects of the inventions will be described with reference to details discussed below, and the accompanying drawings will illustrate the various embodiments. The following description and drawings are illustrative of the invention and are not to be construed as limiting the invention. Numerous specific details are described to provide a thorough understanding of various embodiments of the present invention. However, in certain instances, well-known or conventional details are not described in order to provide a concise discussion of embodiments of the present inventions.

Reference in the specification to "one embodiment" or "an embodiment" or "another embodiment" means that a particular feature, structure, or characteristic described in conjunction with the embodiment can be included in at least one embodiment of the invention. The appearances of the phrase "in one embodiment" in various places in the specification do not necessarily all refer to the same embodiment.

Referring to the figures, a trigger assembly according to the present disclosure is described in further detail. In the depicted embodiment, the trigger assembly is for a firearm. The trigger assembly, also referred to as a trigger mechanism 10, is configured to fit to a lower receiver 5 of a firearm. In the depicted embodiment, the lower receiver is constructed of injection molded polymer. In the depicted embodiment, the injection molded polymer receiver 5 has a magazine well 12 and a cavity 11 for receiving a trigger mechanism 10. It should be appreciated that many alternative receiver configurations are possible including, for example, machined lower receivers of metal or polymer, molded or printed lower receivers of metal or polymer, or stamped metal lower receivers.

In the depicted embodiment, the trigger mechanism 10 includes a trigger body 2. The trigger body includes a downwardly extending finger engaging trigger member portion 13. It should be appreciated that many alternative configurations are possible. For example, in an alternative embodiment the finger engaging trigger member 13 could be straight, angled, curved, etc.

In the depicted embodiment, the trigger mechanism 10 includes a connector 3 nested within the trigger body 2. The connector 3 is pivotally connected to the trigger body 2 by a trigger pin 8 that extends through an aperture 14 of the trigger body 2, an aperture 15 of the connector 3, and an aperture 16 of the trigger spring 4. The connector 3 is pivotally connected to the injection molded polymer receiver 5 by a connector pin 7 that extends through an aperture 19 of the connector, and an aperture 20 of the injection molded polymer receiver 5. It should be appreciated that many alternative configurations are possible. For example, in an alternative embodiment the connector pin could extend through an intermediate component which is then connected to the receiver.

In the depicted embodiment, the trigger mechanism 10 includes a trigger bar 1 nested within the connector 3. The trigger bar 1 is pivotally connected to the connector 3 by a trigger bar pin 6 that extends through an aperture 17 of the connector 3, and an aperture 18 of the trigger bar 1. In the depicted embodiment, pivotal motion of the connector 3 cams the forward portion of the trigger bar 1, thereby creating translational movement at the rearward portion of the trigger bar 1. In the depicted embodiment, the translational movement of the rearward portion of the trigger bar is configured to interface with the fire control to release the striker and thereby fire the weapon. It should be appreciated that many other alternative configurations could be used to create translational movement in the trigger bar 1.

In the depicted embodiment, the trigger body 2 includes a camming surface 22 located at the upper rearward portion of the trigger body 2. In the depicted embodiment, the camming surface 22 is configured to engage a machined protrusion 21 located in the middle portion of the trigger bar 1. In the depicted embodiment, the camming surface 22 is configured to block the connector 3 from rotating in the firing direction (counterclockwise) until the finger engaging trigger member 13 is depressed. In the depicted embodiment, the pivot range of the connector 3 is limited to prevent the fire control from releasing the striker and thereby firing the weapon until the finger engaging trigger member 13 of the trigger body 2 is in the depressed orientation. In the depicted embodiment, the trigger body 2 is configured to limit the pivot range of the connector 3 by a consistent amount until the finger engaging trigger member 13 of the trigger body 2 is in a fully depressed orientation.

In the depicted embodiment, the connector 3 is allowed to pivot once the finger engaging trigger member 13 of the trigger body 2 is in a fully depressed orientation and the camming surface 22 of the trigger body 2 is not engaged with the machined protrusion 21 of the trigger bar 1.

In the depicted embodiment, the trigger body 2 includes an upper portion 23 located at the upper forward portion of the trigger body 2. In the depicted embodiment, the connector 3 includes an upper portion 24 at the upper rearward portion of the connector 3. In the depicted embodiment, the finger engaging trigger member 13 of the trigger body 2 is in a fully depressed orientation when the upper portion 23 of the trigger body 2 is pivoted 3 to 20 degrees to be flush with the upper portion 24 of the connector 3. In the depicted embodiment, further rearward movement of the finger engaging trigger member 13 of the trigger body 2 pivots the connector 2 (counterclockwise). It should be appreciated that many other alternative configurations could be used to pivot the connector 3.

In the depicted embodiment, the trigger mechanism 10 includes a trigger spring 4 configured to engage the upper portion of the trigger body 2 and the upper portion of the connector 3 to bias the finger engaging trigger member 13 of the trigger body 2 in a forward (clockwise) position. In the depicted embodiment, the trigger spring 4 is configured to be in constant contact with the connector 3 and the trigger body 2. It should be appreciated that many other alternative configurations could be used to bias the finger engaging trigger member 13 of the trigger body 2 in the forward (clockwise) direction.

A method of assembling a firearm is also provided. In the depicted embodiment, the method includes the steps of inserting the trigger mechanism 10 into a lower receiver 5 such that the finger engaging trigger member 13 of the trigger body 2 extends through a trigger receiving slot in the lower receiver 5. In the depicted embodiment, the method also includes the step of extending a pivot pin 7 through an aperture 19 of the trigger mechanism 10, and through an aperture 20 of the receiver 5 to secure a portion of the lower receiver 5.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A trigger mechanism for a firearm comprising:

a connector adapted to be pivotally connected to a firearm receiver, a trigger pivotally connected to said connector, and a trigger bar pivotally connected to said connector, said trigger and trigger bar configured such that said trigger engages said trigger bar to block said connector from pivoting until said trigger is depressed rearwardly, said connector permitted to pivot once said trigger is fully depressed rearwardly such that said trigger is not engaged with said trigger bar, whereupon pivotal motion of said connector drives said trigger bar rearwardly to release a striker of the firearm to fire the firearm, wherein said connector has an uppermost rearward portion and said trigger has an uppermost forward portion, and when said trigger is fully depressed rearwardly said uppermost forward portion of said trigger is flush with said uppermost rearward portion of said connector.

2. The trigger mechanism of claim 1 further comprising a spring configured to engage an upper portion of said connector and an upper portion of said trigger to bias a lower portion of said trigger forwardly.

3. The trigger mechanism of claim 1 wherein said trigger has a camming surface on a rearward side of an upper portion of said trigger and an intermediate portion of said trigger bar has a protrusion, said camming surface and protrusion configured such that said camming surface and protrusion engage to block said connector from pivoting until a lower portion of said trigger is depressed rearwardly, and disengage to permit pivoting of said connector once said lower portion of said trigger is fully depressed rearwardly.

4. The trigger mechanism of claim 1 wherein said trigger pivots about 3 degrees to about 20 degrees for said upper forward portion of said trigger to be flush with said upper rearward portion of said connector.

5. A trigger mechanism for a firearm comprising:

a connector adapted to be pivotally connected to a firearm receiver, a trigger pivotally connected to said connector, and a trigger bar pivotally connected to said connector, said trigger and trigger bar configured such that said trigger engages said trigger bar to block said connector from pivoting until said trigger is depressed rearwardly, said connector permitted to pivot once said trigger is fully depressed rearwardly such that said trigger is not engaged with said trigger bar, whereupon pivotal motion of said connector drives said trigger bar rearwardly to release a striker of the firearm to fire the firearm, wherein the pivot connection of said trigger to said connector is rearward of the pivot connection of said trigger bar to said connector when a muzzle of the firearm is forward, and the pivot connection of said connector to the firearm receiver is above the pivot connections of said trigger to said connector and said trigger bar to said connector.

6. A trigger mechanism for a firearm comprising:

a connector having an upper portion, a lower forward portion, and a lower rearward portion, said upper portion adapted to be pivotally connected to a firearm receiver, a trigger having an upper portion and a lower portion and being pivotally connected between said upper and lower portions to said lower rearward portion of said connector, a trigger bar having a forward portion, a rearward portion, and an intermediate portion between said forward and rearward portions, said forward portion pivotally connected to said lower forward portion of said connector, a spring configured to engage said upper portion of said connector and said upper portion of said trigger to bias said lower portion of said trigger forwardly, said trigger having a camming surface on a rearward side of said upper portion of said trigger, and said intermediate portion of said trigger bar having a protrusion, said camming surface configured to engage said protrusion to block said connector from pivoting until said lower portion of said trigger is depressed rearwardly, said connector permitted to pivot once said lower portion of said trigger is fully depressed rearwardly such that said camming surface is not engaged with said protrusion, whereupon pivotal motion of said connector drives said forward portion of said trigger bar rearwardly creating translational movement of said rearward portion of said trigger bar to release a striker of the firearm to fire the firearm, wherein the pivot connection of said trigger to said connector is rearward of the pivot connection of said trigger bar to said connector, and the pivot connection of said connector to the firearm receiver is above the pivot connections of said trigger to said connector and said trigger bar to said connector, and wherein said connector has an uppermost rearward portion and said trigger has an uppermost forward portion, and when said trigger is fully depressed rearwardly said uppermost forward portion of said trigger is flush with said uppermost rearward portion of said connector.

* * * * *